US008618739B2

(12) United States Patent
Braun et al.

(10) Patent No.: US 8,618,739 B2
(45) Date of Patent: Dec. 31, 2013

(54) CIRCUIT ARRANGEMENT AND METHOD FOR OPERATING DISCHARGE LAMPS

(75) Inventors: Alois Braun, Neuburg (DE); Walter Limmer, Munich (DE); Maximilian Schmidl, Pullach (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 505 days.

(21) Appl. No.: 12/773,065

(22) Filed: May 4, 2010

(65) Prior Publication Data

US 2010/0277093 A1 Nov. 4, 2010

(30) Foreign Application Priority Data

May 4, 2009 (DE) ..... 10 2009 019 904

(51) Int. Cl.
*H05B 39/02* (2006.01)

(52) U.S. Cl.
USPC ..... 315/209 R; 315/224; 315/306; 315/307; 315/310

(58) Field of Classification Search
USPC ..... 315/360, 362, 200 R, 209 R, 224, 225, 315/291, 297, 299, 311
See application file for complete search history.

(56) References Cited

U.S. PATENT DOCUMENTS

| | | | | |
|---|---|---|---|---|
| 4,434,395 | A * | 2/1984 | Higuchi | 320/166 |
| 5,001,685 | A | 3/1991 | Hayakawa | |
| 5,262,931 | A * | 11/1993 | Vingsbo | 363/16 |
| 5,719,473 | A | 2/1998 | Huber et al. | |
| 6,304,460 | B1 | 10/2001 | Cuk | |
| 6,323,600 | B1 * | 11/2001 | Statnic et al. | 315/209 R |
| 6,744,222 | B2 | 6/2004 | Kisaichi et al. | |
| 7,102,251 | B2 * | 9/2006 | West | 307/64 |
| 2002/0057062 | A1 | 5/2002 | Kisaichi et al. | |
| 2005/0083022 | A1 * | 4/2005 | Braun et al. | 323/222 |
| 2007/0247128 | A1 * | 10/2007 | Yang | 323/282 |
| 2008/0252233 | A1 | 10/2008 | Wu | |

FOREIGN PATENT DOCUMENTS

| | | | |
|---|---|---|---|
| CN | 1440586 | A | 9/2003 |
| CN | 101171889 | A | 4/2008 |
| DE | 3625499 | C2 | 1/1992 |
| DE | 202005003632 | U1 | 8/2006 |
| EP | 0671867 | B1 | 11/1999 |
| WO | 2006092130 | A1 | 9/2006 |

OTHER PUBLICATIONS

English-language abstract of EP 0 671 867 B1.
English language abstract of DE 36 25 499 C2; Jan. 16, 1992.

* cited by examiner

*Primary Examiner* — Douglas W Owens
*Assistant Examiner* — Jianzi Chen

(57) ABSTRACT

A circuit arrangement for operating discharge lamps is provided with an input, to which an AC system voltage from a power supply system can be connected, an output, to which at least one discharge lamp can be connected, a backup capacitance, which is arranged between the input and the output, and a switch, which is in a charging current path of the backup capacitance. The circuit arrangement may include a driver configured to clock the switch for a predetermined period of time when the circuit arrangement is switched on for periodically interrupting the charging current path of the backup capacitance.

15 Claims, 3 Drawing Sheets

CIRCUIT ARRANGEMENT AND METHOD FOR OPERATING DISCHARGE LAMPS

CROSS-REFERENCE TO RELATED APPLICATION

This application claims priority to German Patent Application Serial No. 10 2009 019 904.7, which was filed May 4, 2009, and is incorporated herein by reference in its entirety.

TECHNICAL FIELD

Various embodiments relate to a circuit arrangement for operating discharge lamps with an input, to which a system voltage from a power supply system can be connected, and an output, to which at least one discharge lamp can be connected, the circuit arrangement having a step-up converter.

BACKGROUND

Various embodiments are based on a circuit arrangement for operating discharge lamps. Many circuit arrangements for operating discharge lamps have a power factor correction circuit for converting the input voltage into a suitable DC voltage, which is often also regulated, said DC voltage being referred to as the intermediate circuit voltage and then being fed to the inverter. The power factor correction circuit, which is generally a step-up converter in terms of circuit topology, brings about a sinusoidal current consumption of the entire arrangement and at the same time a regulated intermediate circuit voltage of a suitable level. These circuit arrangements are incorporated in control gear for low-pressure or high-pressure discharge lamps and are generally fed by an AC system voltage. In the case of the power factor correction circuit as a step-up converter, the converter switch is arranged between the incoming and return current path of the circuit, i.e. is not directly in the main current path.

In order to keep the intermediate circuit voltage stable and in order to limit ripple currents, such circuit arrangements generally have a so-called intermediate circuit capacitor, which is connected between the two output terminals of the voltage converter or the power factor correction circuit or between the input terminals of the inverter and also acts as backup capacitance for the voltage converter. If the control gear is now switched on, i.e. the entire circuit arrangement is connected to the power supply system, the intermediate circuit capacitor, i.e. the backup capacitance of the step-up converter, is charged via the converter current path of the step-up converter in a very short period of time via the converter inductor and the boost diode, which results in a very high switch-on current, particularly when switching on happens to take place at the system peak. In the worst case scenario, the capacitor is charged over only one system cycle or even only one system half-cycle. In this case, the system peak is intended to mean the time of the (positive or negative) peak value of the system voltage. The current path via which the backup capacitance is charged is referred to below as the charging current path. The level of the switch-on current can be a multiple (measured up to 200×) of the rated operating current. As a result, the use is restricted to an overcurrent protection since the circuit breaker is triggered in the event of a plurality of devices being simultaneously switched on, although the maximum current of the circuit breaker has by far not yet been reached when the rated current of the devices is taken into consideration.

In order to limit the switch-on current, EP 067 18 67 A has therefore proposed a circuit arrangement which has a parallel circuit including a resistor and a thyristor in the current path of the converter. At the switch-on time of the circuit arrangement, the thyristor is off and only the resistor in the current path is active. The intermediate circuit capacitor is charged slowly and with a low current via said resistor. When the intermediate circuit capacitor has been charged to a predetermined voltage, the thyristor is turned on and bridges the resistor, with the result that the losses are kept low during operation. The circuit arrangement requires many additional component parts, however, and has the disadvantage of high power losses at the switch-on time since there is a power drop which should not be underestimated at the current-limiting resistor.

SUMMARY

A circuit arrangement for operating discharge lamps is provided with an input, to which an AC system voltage from a power supply system can be connected, an output, to which at least one discharge lamp can be connected, a backup capacitance, which is arranged between the input and the output, and a switch, which is in a charging current path of the backup capacitance. The circuit arrangement may include a driver configured to clock the switch for a predetermined period of time when the circuit arrangement is switched on for periodically interrupting the charging current path of the backup capacitance.

BRIEF DESCRIPTION OF THE DRAWINGS

In the drawings, like reference characters generally refer to the same parts throughout the different views. The drawings are not necessarily to scale, emphasis instead generally being placed upon illustrating the principles of various embodiments. In the following description, various embodiments are described with reference to the following drawings, in which.

DESCRIPTION

Figure 1:
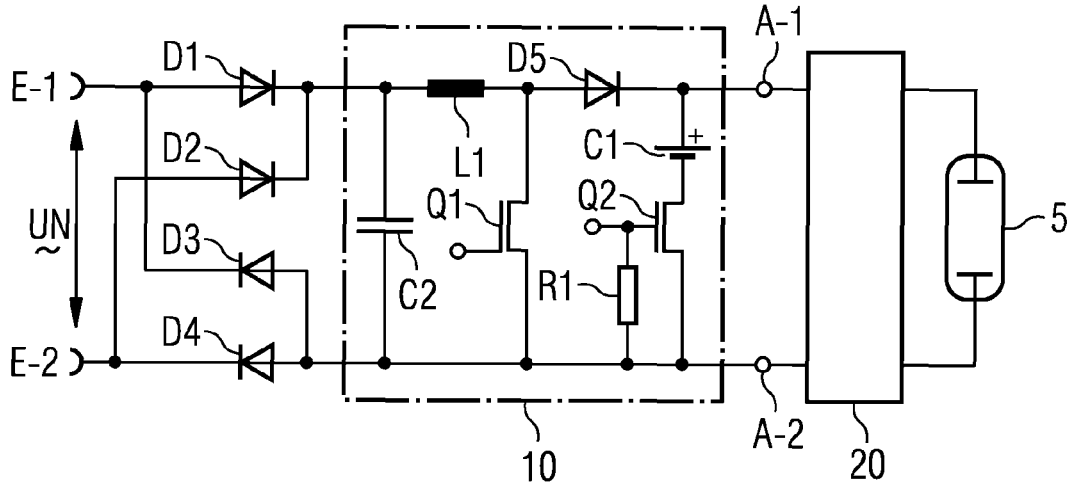
FIG. 1 shows a first embodiment of the circuit arrangement, in which the switch is arranged in series with the backup capacitance between the output terminals of the step-up converter.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide a circuit arrangement for operating discharge lamps with an input, to which a system voltage from a power supply system can be connected, an output, to which at least one discharge lamp can be connected, and a backup capacitance, which is arranged between the input and the output, and a switch, which is in the charging current path of the backup capacitance, which circuit arrangement requires few additional component parts and only produces low power losses.

Various embodiments provide a circuit arrangement for operating discharge lamps with an input, to which an AC system voltage from a power system can be connected, an output, to which at least one discharge lamp can be connected, a backup capacitance, which is arranged between the input and the output, and a switch, which is in the charging current path of the backup capacitance, with the circuit arrangement clocking the switch for a predetermined period of time when said circuit arrangement is switched on for periodically interrupting the charging current path of the backup capacitance. Clocking of the switch results in advantageous slow charging of the backup capacitance, which results in a significant reduction in the switch-on current.

Slow charging of the backup capacitance of the step-up converter is understood below to mean charging over a period of time which is longer than a system half-cycle. In this case, a predetermined current is not exceeded, i.e. the current drawn by the circuit arrangement has an upper limit during the charging operation. This upper limit can be, for example, the rated current consumption of the circuit arrangement.

The switch represents an additional switch to the obligatory converter switch in the step-up converter if the circuit arrangement has a step-up converter. At best, the switch is switched on in the event of a low instantaneous system voltage. In this case, it can be switched on temporarily in each case at a zero crossing of the system voltage and can be switched off again prior to a subsequent peak voltage of the system voltage. However, it can also be switched on temporarily in each case after a peak voltage of the system voltage, and switched off again at the subsequent zero crossing of the system voltage. Finally, it can be switched on temporarily in each case after a peak voltage of the system voltage, and switched off again prior to a subsequent peak voltage U of the system voltage. In this case it is important that the switch is switched on at a time at which the instantaneous system voltage is greater than the voltage across the intermediate circuit capacitor $U_{C1}$ by only a small absolute value. By virtue of this measure, the driving voltage is low and the resultant current is low.

The switch-on duration of the switch in this case advantageously increases at the same switch-on time (based on the system phase) from one zero crossing of the system voltage to the subsequent zero crossing of the system voltage. As a result, the capacitor can be charged in uniform steps until the peak voltage $\hat{U}$ of the system voltage is reached. By way of example, the switch-off time of the switch is dependent on a voltage increase $\Delta U$ of the voltage present across the backup capacitance. In order to increase the capacitor voltage $U_{C1}$ by the same voltage value $\Delta U$ during each charging operation, the switch-off time should be proportional to $$\frac{1}{\omega}\arcsin\frac{\Delta U + U_{C1}}{\hat{U}}.$$

The switch is advantageously arranged in series with the backup capacitance, in the event of the presence of a step-up converter between the input terminals of the step-up converter or the power factor correction circuit and the output terminals of the rectifier. This entails the advantage that the switch is only subjected to the ripple current of the capacitor and the losses are thus minimized during operation. The switch can also be arranged in the charging current path, however. As a result, the flexibility in terms of the arrangement of the switch is increased.

In this case, the switch can be a transistor, for example a metal-oxide field-effect transistor (MOS-FET) or a bipolar transistor. However, the switch can also be a thyristor. Electronic switches have the advantage of considerable robustness and operational safety whilst at the same time low costs.

FIG. 1 shows a first embodiment of the circuit arrangement, in which the transistor Q2 is arranged in series with the backup capacitance between the output terminals of the step-up converter 10. This arrangement may have the advantage that the transistor Q2 can be driven easily and inexpensively since it has a direct relation to the circuit ground, i.e. the potential of the output A-2. In addition, the transistor Q2 is not in the main current path of the step-up converter 10. The main current path of the step-up converter 10 is the path between the inputs E-1, E-2 and the outputs A-1, A-2. It is here that the majority of the current flows, i.e. from E-1 (E-2) to A-1 via D1/D2, L1 and D5 and from E-2 (E-1) via D3/D4 to A-2. In this case, the transistor Q2 is a MOS-FET, which is driven by the control circuit (not shown) of the step-up converter. The remainder of the topology corresponds to a conventional step-up converter. The output terminals of the step-up converter 10 are connected to an inverter 20, whose output is in turn connected to a discharge lamp 5.

Figure 2:
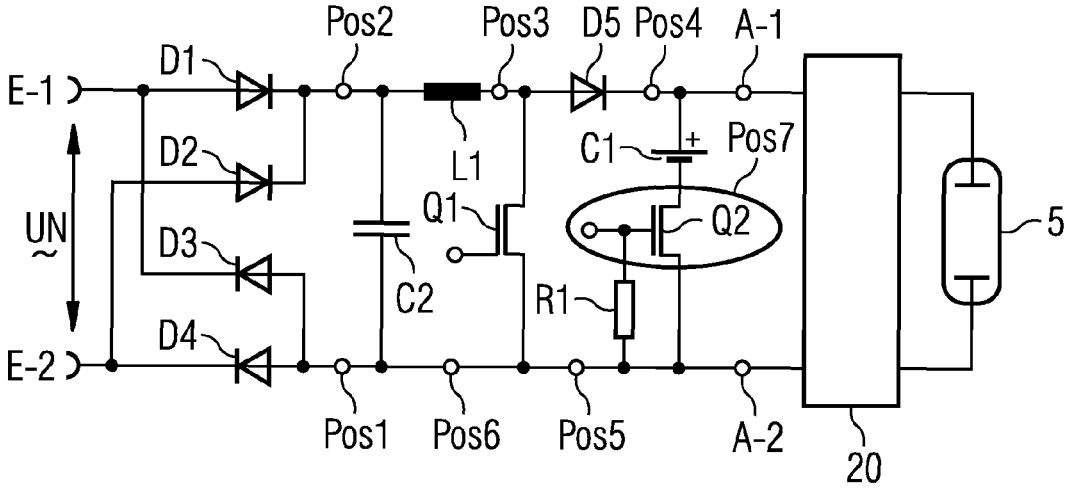
FIG. 2 shows a second embodiment of the circuit arrangement, in which the switch is arranged at different possible points in a current path between an input of the step-up converter and the backup capacitance.

FIG. 2 shows, using dashed lines, the possible switch positions of the transistor Q2 in the step-up converter 10. Only in one position must a transistor be present. Positions 1-6 provide greater flexibility with respect to specific requirements placed on the circuit arrangement, but the transistor needs to carry all of the converter current for this purpose, which entails increased losses, or results in increased component part costs. In this regard positions 3-7 are particularly unfavorable since here the transistor must carry the maximum or peak radiofrequency current of the converter and any interference currents of the converter. Positions 1 and 2 are in this case clearly better since here the switch is protected by the capacitor C2, which captures voltage and current peaks with a relatively high frequency. If the transistor is arranged at one of positions 1, 2, 3 and 6, it can at the same time act as protection for the converter transistor Q1 in the case of overvoltage pulses when driven correspondingly.

Figure 3:
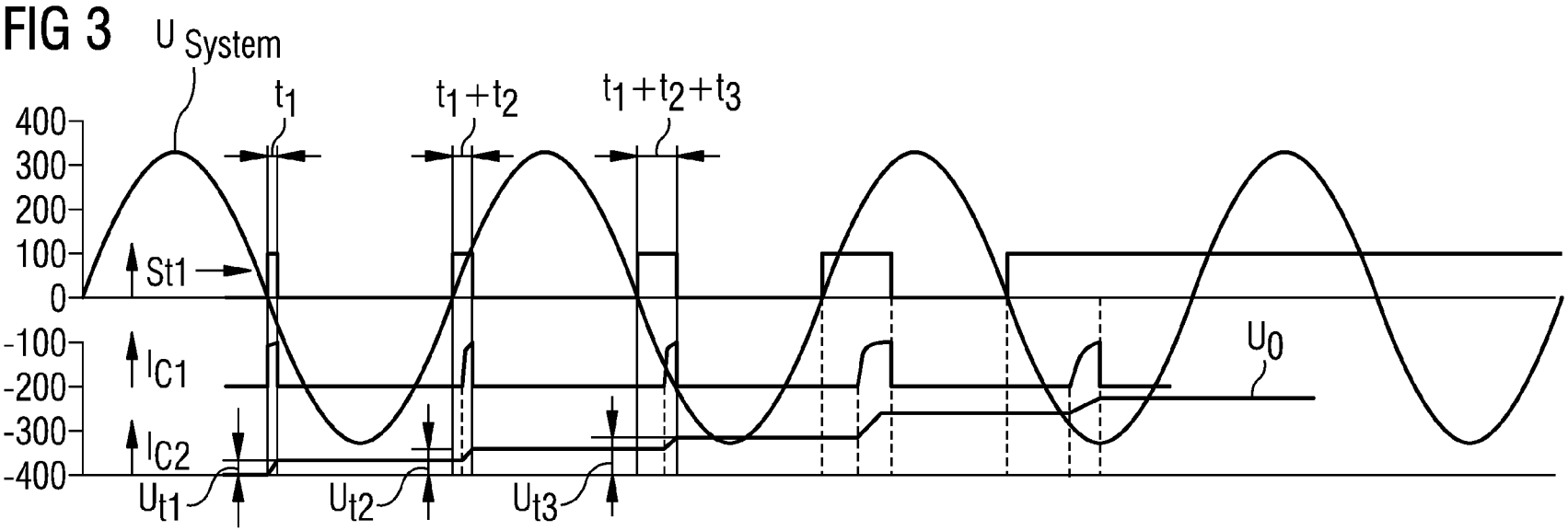
FIG. 3 shows a few relevant variables for illustrating the slow charging of the backup capacitance by virtue of clocking of the switch in a fashion which is synchronous with the system voltage.

FIG. 3 shows an example of operation of the transistor Q2 with system-synchronous clocking when the circuit arrangement is switched on. The signal $U_{system}$ is the system voltage, $S_{T1}$ is the switching signal for the transistor Q1. $I_{C1}$ is the charging current into the backup capacitor C1, and $U_{C1}$ is the voltage to which the capacitor is charged. At the switch-on time, the circuit arrangement detects the first zero crossing of the AC system voltage and switches on the transistor Q2 for a first time span $t_{C1}=t_1$, which is very short. During this time, a current flows into the capacitor C1 and charges said capacitor to a first voltage $U_{t1}$. This $U_{t1}$ corresponds to $\Delta U$, which defines the further charging of the capacitor C1 at the following crossings as a fixed variable. At the next zero crossing of the system voltage, the transistor Q2 is switched on again for a second time span $t_{C1}=t_1+t_2$ and the capacitor C1 is charged to a second voltage $U_{t2}$. This is necessary since the capacitor C1 has already been charged to the first voltage $U_{t1}$ and therefore there is no current flowing in the first part of the second time span for charging the capacitor since the instantaneous value of the system voltage is below the capacitor voltage $U_{C1}$. This is clear from the curve profile of the charging current $I_{C1}$. The time span $t_2$ is defined in this example such that the capacitor is always charged further by a voltage $\Delta U$. $\Delta U$ is in this case a fixed value, for example 20 V. After the time span $t_{C1}=t_1+t_2$, the transistor Q2 is switched off again and the next zero crossing is awaited. At the next zero crossing, the transistor Q2 is then switched on again for a time span $t_{C1}=t_1+t_2+t_3$. This procedure is carried out until the voltage $U_{C1}$ which drops across the capacitor C1 differs from the system peak voltage $\hat{U}$ by less than $\Delta U$.

In a further variant of the operation with system-synchronous clocking, the capacitor C1 is not charged further by in each case a fixed voltage $\Delta U$, but the switch-on duration of the transistor Q2 is increased in each case by a fixed time span. The time span by which the switch-on time $t_{C1}$ of the transistor is changed is therefore fixed, for example $t_{C1}=t_1$ at the first zero crossing, $t_{C1}=2*t_1$ at the second zero crossing etc. Thus, the respective rise in the charging voltage of the capacitor is different since the system voltage follows a sinusoidal function. The criterion for concluding the switch-on current limitation operation can be similar to as in the first variant, with the residual voltage $\Delta U$ by which the capacitor voltage $U_{C1}$ differs from the peak system voltage $\hat{U}$ being a predetermined fixed voltage, for example 25 V.

Since the charging of the capacitor C1 during operation with system-synchronous clocking is distributed over a plurality of system half-cycles, the resultant current consumption is correspondingly lower. By virtue of the system-synchronous clocking which begins the charging of the capacitor at a zero crossing of the system voltage, the voltage step between the system voltage and the capacitor voltage is always in a predefined voltage range, and the resultant charging current is correspondingly low. Given a corresponding configuration of the transistor switch-on times, the resultant current consumption can be set in such a way that it is no greater than the current consumption during rated operation of the circuit arrangement.

Figure 4:
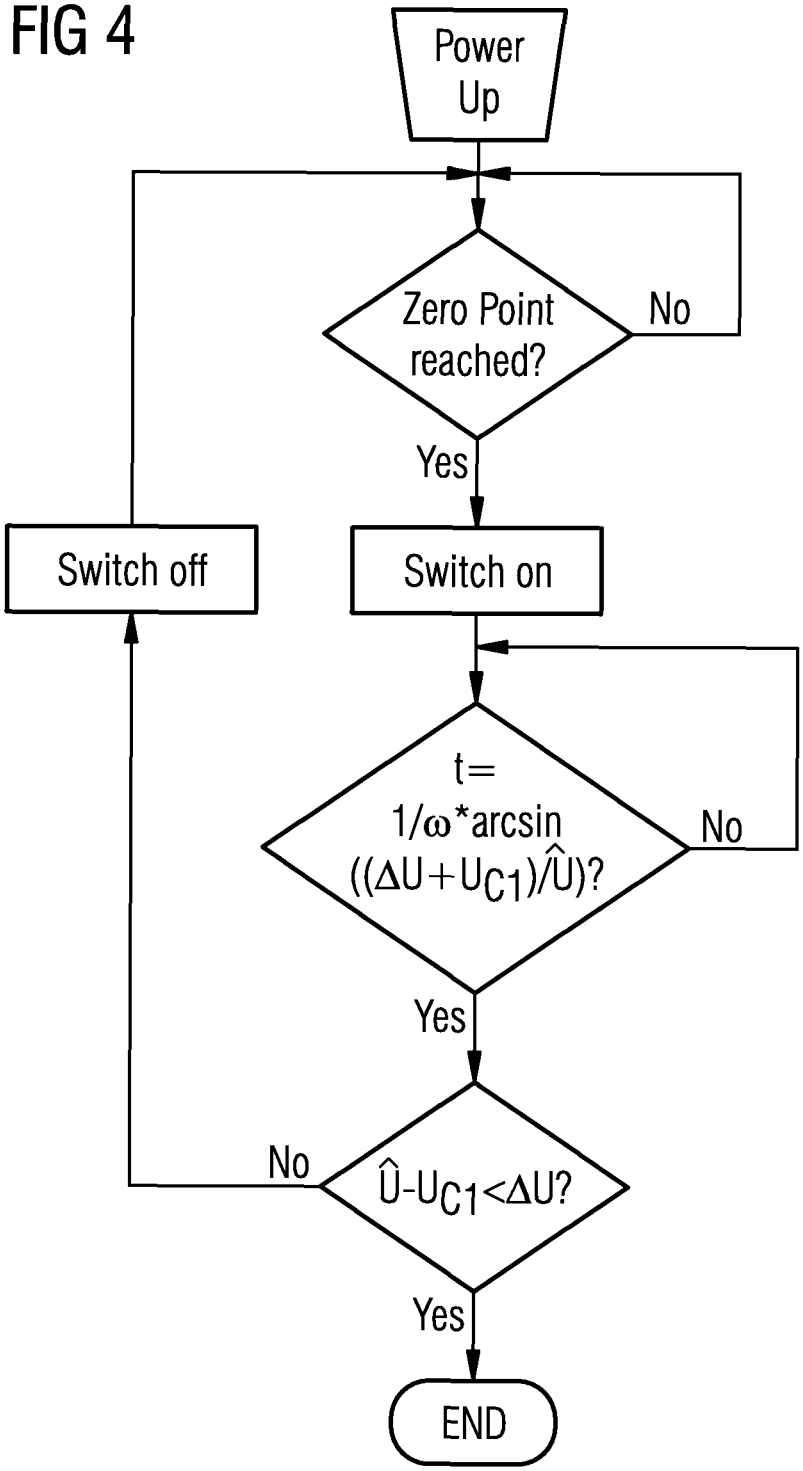
FIG. 4 shows a flow chart for illustrating the method, which is implemented by the circuit arrangement.

FIG. 4 shows a flow chart which illustrates a variant of the method implemented by the circuit arrangement. Once the power supply has been switched on, the first zero crossing of the system voltage is awaited. When said first zero crossing takes place, the transistor Q2 is switched on. There is then a wait until the capacitor has reached the desired voltage $\Delta U$. This can take place either by direct measurement of the capacitor voltage or, in the case of a 50 Hz system voltage, by the following formula:

$$t_{C1} = 10\ \text{ms}\cdot\frac{1}{\pi}\cdot\arcsin\frac{\Delta U = U_{C1}}{\hat{U}}.$$

In this case, $\Delta U$ is the voltage by which the capacitor is intended to be charged again. When this time has elapsed, the transistor Q2 is switched off again and the next zero crossing of the system voltage is awaited. This is repeated until the charging voltage $U_{C1}$ approximately corresponds to the peak system voltage $\hat{U}$. For other frequencies, the formula $$t_{C1} = \frac{1}{\omega}\cdot\arcsin\frac{\Delta U + U_{C1}}{\hat{U}}$$

can be used, where $\omega=2*\pi*f_{system}$, and in this case f can be f=50 Hz, for example. The charging voltage $U_{C1}$ of the capacitor should in this case still be slightly lower than the peak system voltage $\hat{U}$ since a final charging cycle still takes place as the transistor Q2 is finally switched on. Therefore, as soon as the voltage $U_{C1}$ present across the capacitor is greater than $\hat{U}-\Delta U$, for example, the transistor is switched on permanently, and the circuit arrangement transfers to the normal lamp operating mode.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A circuit arrangement for operating discharge lamps with an input, to which an AC system voltage from a power supply system can be connected, an output, to which at least one discharge lamp can be connected, a backup capacitance, which is arranged between the input and the output, and a switch, which is in a charging current path of the backup capacitance, the circuit arrangement comprising:

a driver configured to clock the switch for a predetermined period of time when the circuit arrangement is switched on for periodically interrupting the charging current path of the backup capacitance, wherein the driver configured to clock the switch in system-synchronous fashion, the circuit arrangement being configured to switch on the switch temporarily in each case at a zero crossing of an applied system voltage, and switching off said switch again prior to a subsequent peak voltage of the system voltage.

2. The circuit arrangement as claimed in claim 1, wherein the driver configured to clock the switch in system-synchronous fashion, the circuit arrangement being configured to switch on the switch temporarily in each case after a peak voltage of an applied system voltage and switching off said switch again at the subsequent zero crossing of the system voltage.

3. The circuit arrangement as claimed in claim 1, wherein the circuit arrangement comprises a driver configured to clock the switch in system-synchronous fashion, the circuit arrangement being configured to switch on the switch temporarily in each case after a peak voltage of an applied system voltage, and switching off said switch again prior to a subsequent peak voltage of the system voltage.

4. The circuit arrangement as claimed in claim 1, wherein the switch-on duration of the switch increases from one zero crossing of the system voltage to the subsequent zero crossing of the system voltage.

5. The circuit arrangement as claimed in claim 1, wherein the switch-off time of the switch is dependent on a voltage increase $\Delta U$ of the voltage $U_{C1}$ present across the backup capacitance.

6. The circuit arrangement as claimed in claim 5, wherein the switch-off time is proportional to $$1\frac{1}{\omega}\arcsin\frac{\Delta U + U_{C1}}{\hat{U}},$$

where $$\omega=2*\pi*f_{system}.$$

7. The circuit arrangement as claimed in claim 1, wherein the switch is arranged in series with the backup capacitance.

8. The circuit arrangement as claimed in claim 1, wherein the switch is arranged in a current path between the input of the circuit arrangement and the backup capacitance.

9. The circuit arrangement as claimed in claim 1, wherein the circuit arrangement comprises a step-up converter, and wherein the back-up capacitance is an output capacitance of the step-up converter.

10. The circuit arrangement as claimed in claim 9, wherein the switch is an additional switch to a converter switch of the step-up converter.

11. The circuit arrangement as claimed in claim 1, wherein the switch comprises a transistor.

12. The circuit arrangement as claimed in claim 11, wherein the transistor is a metal-oxide transistor.

13. The circuit arrangement as claimed in claim 11, wherein the transistor is a bipolar transistor.

14. The circuit arrangement as claimed in claim 1, wherein the switch comprises a thyristor.

15. A method for operating discharge lamps, with a circuit arrangement for implementing the method, the circuit arrangement comprising an input, to which an AC system voltage from a power supply system can be connected, and an output, to which at least one discharge lamp can be connected, and a backup capacitance, which is arranged between the input and output, and a switch which is in a charging current path of the backup capacitance, the method comprising the following processes which are repeated a plurality of times: detecting a voltage zero crossing of an AC system voltage present at the input; switching-on the switch; testing whether a predetermined switch-on time span of the switch has been reached, or testing whether the voltage present across the backup capacitance has risen by a predetermined value; if so then to the next process; and testing whether the voltage present across the backup capacitance has reached a predetermined value, if no then switching-off of the switch, and if yes then conclusion of the method.

* * * * *